US006343982B1

(12) United States Patent
Sun

(10) Patent No.: US 6,343,982 B1
(45) Date of Patent: Feb. 5, 2002

(54) PNEUMATIC SANDER STRUCTURE

(76) Inventor: Yung Yung Sun, No. 66, Shang Tien Street, Ta Li City, Taichung Hsien (TW)

( * ) Notice: Subject to any disclaimer, the term of this patent is extended or adjusted under 35 U.S.C. 154(b) by 0 days.

(21) Appl. No.: 09/637,690

(22) Filed: Aug. 15, 2000

(51) Int. Cl.[7] ..... B24B 23/04
(52) U.S. Cl. ..... 451/357; 451/359; 451/344
(58) Field of Search ..... 451/344, 351, 451/357, 359, 442, 451, 452, 455

(56) References Cited

U.S. PATENT DOCUMENTS 4,660,329 A * 4/1987 Hutchins ..... 451/357
4,671,019 A * 6/1987 Hutchins ..... 451/357
5,357,715 A * 10/1994 Hiramatsu ..... 451/357
5,392,568 A * 2/1995 Howard, Jr. et al. ..... 451/357
5,445,558 A * 8/1995 Hutchins ..... 451/357
5,453,040 A * 9/1995 Schaal et al. ..... 451/357
6,257,970 B1 * 7/2001 Huber ..... 451/357

* cited by examiner

*Primary Examiner*—Derris H. Banks
(74) *Attorney, Agent, or Firm*—Rosenberg, Klein & Lee

(57) ABSTRACT

A pneumatic sander structure including a dustproof cover disposed between a top face of the middle section of the shaft and the bearing in the lower bearing seat. The outer edge of the dustproof cover upward extends to the lower bearing seat and is kept spaced therefrom by a very small gap, whereby the air flowing into the lower bearing seat can be exhausted, while the dust outside the dustproof cover is prevented from entering the dustproof cover.

5 Claims, 4 Drawing Sheets

PNEUMATIC SANDER STRUCTURE

BACKGROUND OF THE INVENTION

The present invention relates to a pneumatic sander structure which is able to prolong using life of the bearing and will not interfere with the operation of the grinding mechanism.

A conventional pneumatic sander employs a pneumatic driving mechanism which has a shaft for driving an eccentric block of a grinding mechanism to rotate. The eccentric block further drives a grinding disc at the bottom end thereof to rotate. An annular groove is formed on the lower bearing seat, in which a slightly elastic rubber dustproof cover is fitted. The dustproof cover is a hollow body. The lower end of the vertical circumferential wall of the dustproof cover is tapered so that the vertical circumferential wall has an inward inclined lower end. The vertical circumferential wall is fitted around a flange of the lower bearing seat. The bottom end of the inclined circumferential wall is positioned at a position spaced from the vertical face of the middle portion of the eccentric block by a gap. The angle edge of the inclined circumferential wall slightly touches the top face of the eccentric block to define a space between the eccentric block and the dustproof cover. When the eccentric block is rotated relative to the outer housing and a strong revolving air flow is produced, the space is prevented from being disturbed by the air flow so that the grinding powder will not escape into the lower bearing.

Referring to FIG. 6, a clearance exists between the lower bearing seat 81 and the shaft 82 and the bearing 83 has a gap for ventilation. Therefore, the high pressure air for drivingly operating the pneumatic driving mechanism will flow through the clearance between the lower bearing seat 81 and the shaft 82 into the lower bearing seat 81 and flow through the bearing 83 into the space inside the dustproof cover 84. The air will then flow out through the gap between the angle edge of the inclined circumferential wall 841 of the dustproof cover 84 and the top face of the eccentric block 85. When the air is exhausted, it will exert a pushing force onto the slightly elasitc dustproof cover 84, making the inclined circumferential wall 841 thereof contact with the top face of the eccentric block 85. Therefore, the angle edge of the inclined circumferential wall 841 will be continuously abraded by the top face of the eccentric block 85. This slows down the rotational speed of the eccentric block 85 and the inclined circumferential wall 841 is worn out to enlarge the gap between the angle edge and the top face of the eccentric block 85. As a result, the powder will intrude into the bearing 83 to affect the using life of the bearing 83.

SUMMARY OF THE INVENTION

It is therefore a primary object of the present invention to provide a pneumatic sander structure in which the dustproof cover is disposed between a top face of the middle section of the shaft and the bearing in the lower bearing seat. The outer edge of the dustproof cover upward extends to the lower bearing seat and is kept spaced therefrom by a very small gap. Therefore, the air flowing into the lower bearing seat can be exhausted, while the powder produced outside the dustproof cover during grinding operation is prevented from entering the bearing of the lower bearing seat. Therefore, double effects of no interference with the operation and prolonging using life of the bearing can be achieved.

According to the above object, the pneumatic sander structure of the present invention includes a housing, a pneumatic driving mechanism and a grinding mechanism which are disposed in the housing. The housing has an air incoming way and a air outgoing way. The pneumatic driving mechanism has an annular wall in which a rotary body with vanes is placed. The annular wall is formed with inlets and outlets for rotating the rotary body. An upper and a lower ends of the annular wall are respectively connected with an upper and a lower bearing seats having bearings therein. A shaft is fitted into the rotary body and the two bearings. A bottom end of the shaft is an eccentric block of the grinding mechanism. A top end of the eccentric block is a middle section coaxial with the shaft. A hollow dustproof cover is disposed between the middle section and the lower bearing seat. The dustproof cover is positioned between a top face of the middle section and the bearing in the lower bearing seat. The dustproof cover is fixedly clamped by the top face of the middle section and an inner ring of the bearing. The dustproof cover is formed with a recess corresponding to the outer ring for avoiding unnecessary abrasion. An outer edge of the dustproof cover upward extends to a lower bottom face of the lower bearing seat and is kept spaced therefrom by a very small gap.

The present invention can be best understood through the following description and accompanying drawings wherein:

DETAILED DESCRIPTION OF THE PREFERRED EMBODIMENTS

Figure 2:
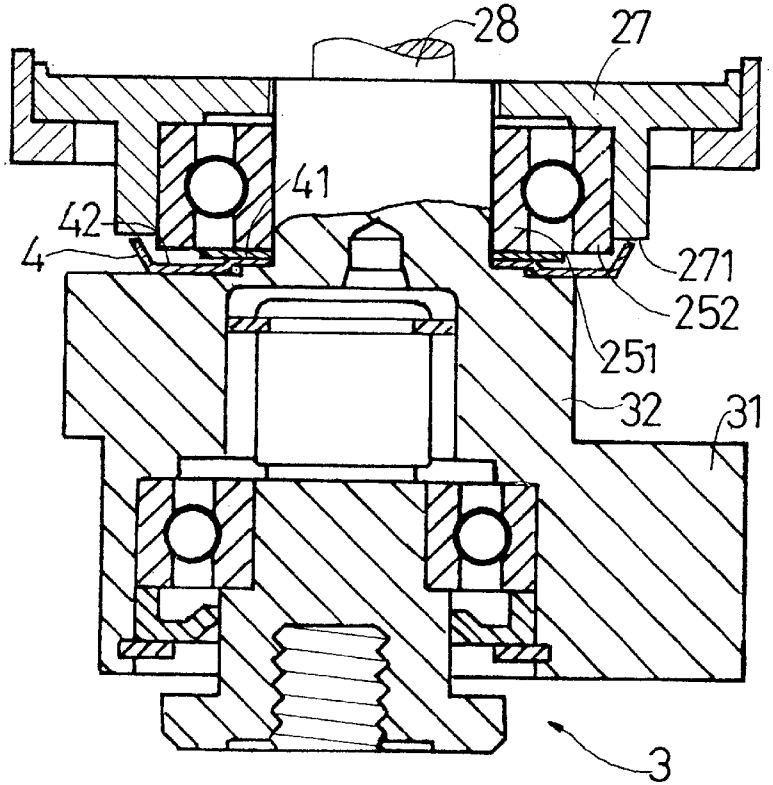
FIG. 2 is a sectional view of the lower bearing s eat and the dustproof cover of the present invention.
Figure 4:
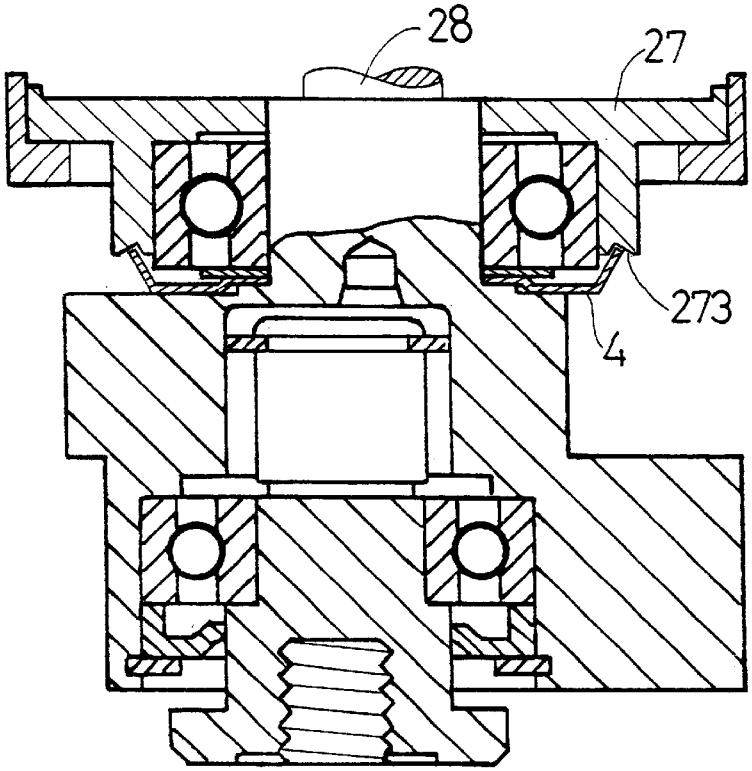
FIG. 4 is a sectional view showing the structure of a second embodiment of the present invention.

Please refer to FIGS. 4 and 2. The pneumatic sander structure of the present invention includes a housing 1, a pneumatic driving mechanism 2 and a grinding mechanism 3 which are disposed in the housing 1. The housing 1 has an air incoming way 11 and a air outgoing way 12. The pneumatic driving mechanism 2 has an annular wall 21 in which a rotary body 23 with vanes is placed. The annular wall 21 is formed with inlets 211 and outlets 212 for rotating the rotary body 23. The upper and lower ends of the annular wall 21 are respectively connected with an upper and a lower bearing seats 26, 27 having bearings 24, 25 therein. A shaft 28 is fitted into the rotary body 23 and the two bearings 24, 25. The bottom end of the shaft 28 is an eccentric block 31 of the grinding mechanism 3. The top end of the eccentric block 31 is a middle section 32 coaxial with the shaft 28. A hollow dustproof cover 4 made of metal sheet by punching is disposed between the middle section 32 and the lower bearing seat 27. The dustproof cover 4 is positioned between the top face of the middle section 32 and the bearing 25 in the lower bearing seat 27. The dustproof cover 4 is fixedly clamped by the top face of the middle section 32 and a washer 41 disposed under inner ring 251 of the bearing 25. The outer diameter of the washer 41 is smaller than the inner diameter of the outer ring 252 of the bearing 25. The dustproof cover 4 is formed with a recess 42 corresponding to the outer ring 252 for avoiding unnecessary abrasion. The outer edge of the dustproof cover 4 upward extends to a lower bottom face 271 of the lower bearing seat 27 and is kept spaced therefrom by a very small gap.

Figure 1:
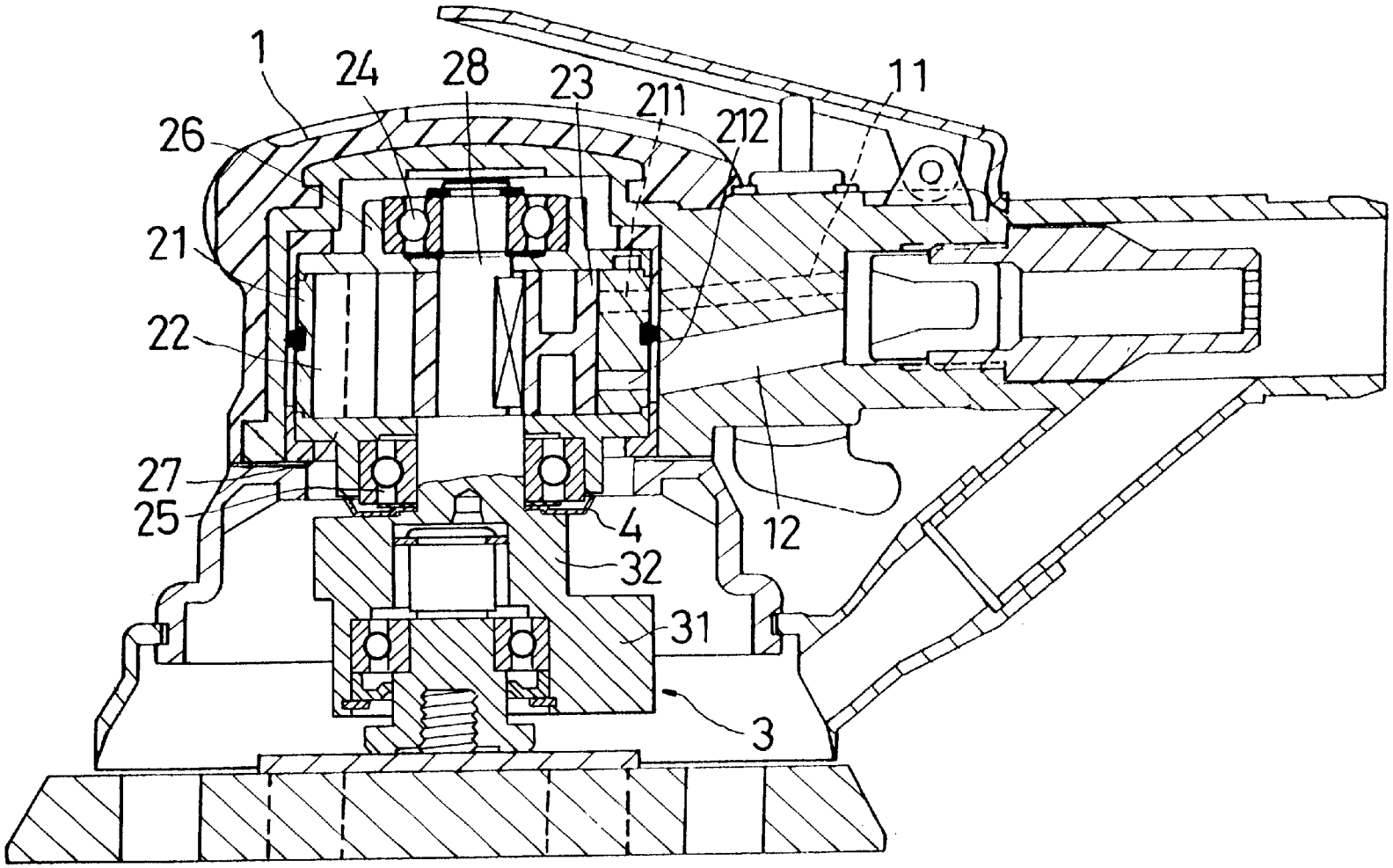
FIG. 1 is a plane sectional view of the present invention.
Figure 3:
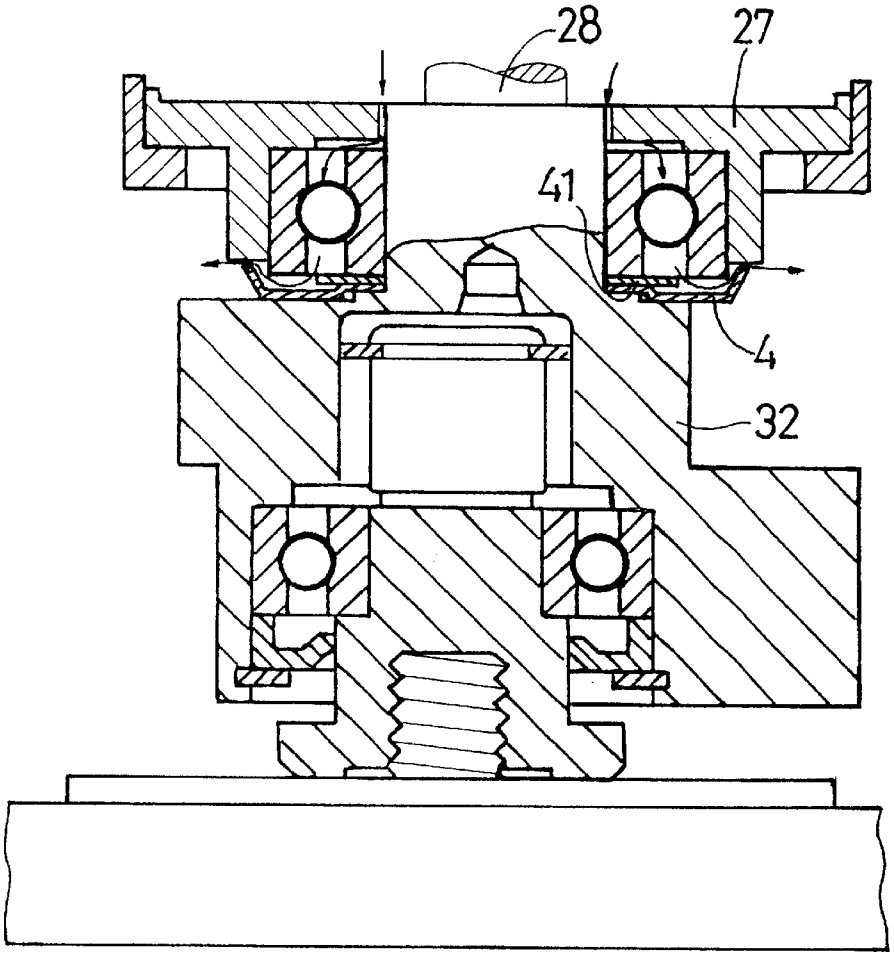
FIG. 3 is a sectional view showing the flowing direction of the high pressure air during operation of the present invention.

Referring to FIG. 3, the dustproof cover 4 is made of metal sheet and molded by punching so that the dustproof cover 4 is not subject to deformation caused by pushing and pressing force of the discharged high pressure air. Moreover, the metal sheet-made dustproof cover 4 can have a dimensional precision controlled within a certain error. In generally, the dustproof cover 4 can be such made that the gap between the dustproof cover 4 and the lower bearing seat 27 is kept under 0.05 mm. Therefore, the powder produced during grinding operation will not be entrained by the air flow into the dustproof cover 4 to affect the using life of the bearing 25. In addition, the air entering the lower bearing seat 27 can be smoothly exhausted without interfering with the operation of the eccentric block 32. Therefore, double effects of no interference with the operation and prolonging using life of the bearing 25 can be achieved.

FIG. 4 shows a second embodiment of the present invention, in which the bottom face 271 of the lower bearing seat 27 is formed with an annular groove 273. The outer edge of the dustproof cover 4 extends into the annular groove 273 and is kept spaced from the circumference of the annular groove 273 by a very small gap. Accordingly, the same effects as the first embodiment can be achieved.

Figure 5:
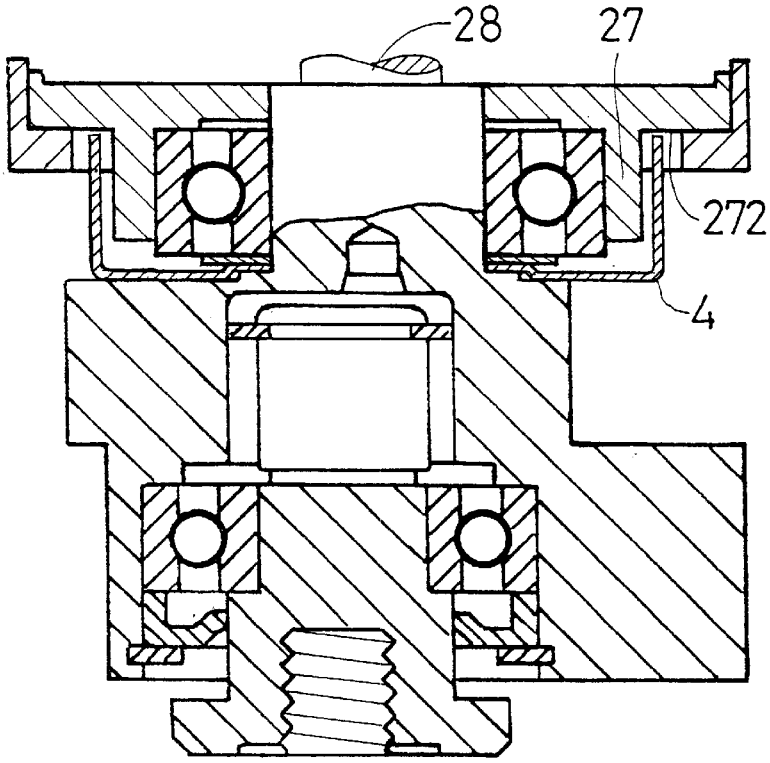
FIG. 5 is a sectional view showing the structure of a third embodiment of the present invention.
Figure 6:
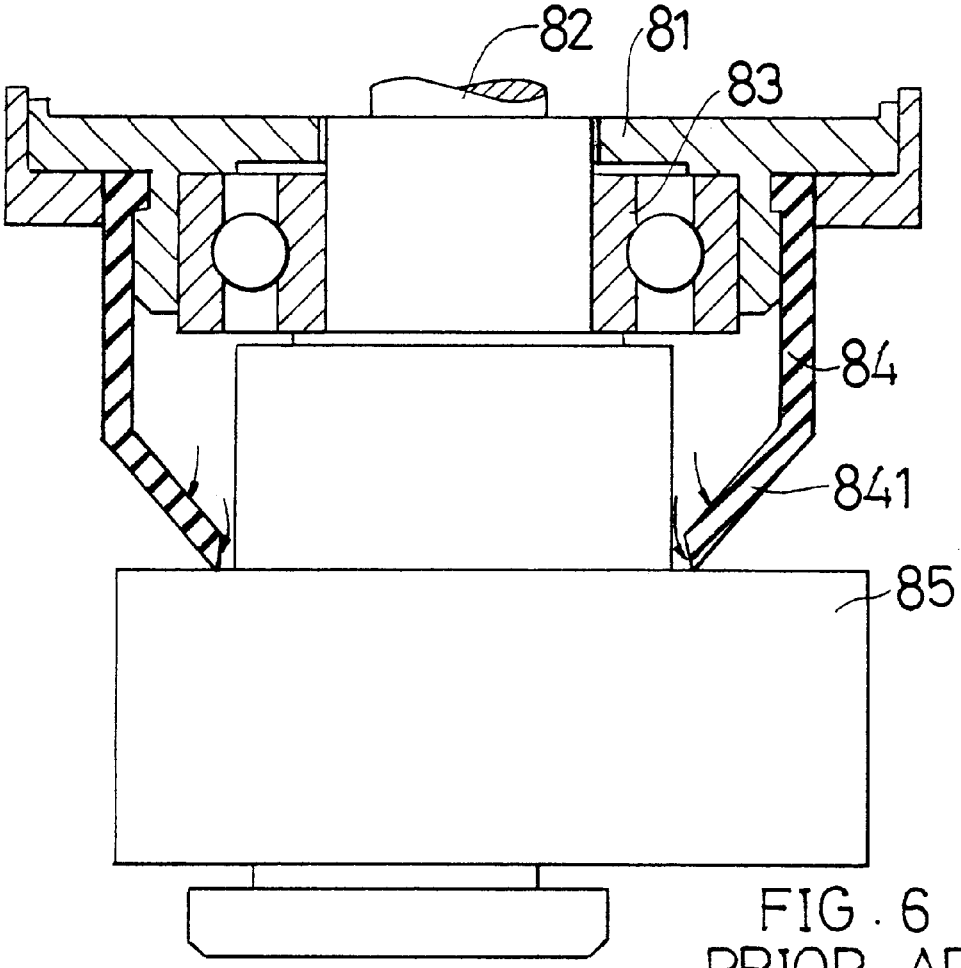
FIG. 6 PRIOR ART
FIG. 6 is a sectional view of a conventional pneumatic sander, showing that during operation, the high pressure air pushes the dustproof cover.

FIG. 5 shows a third embodiment of the present invention, in which the outer edge of the dustproof cover 4 extends to a higher bottom face 272 of the lower bearing seat 27 and is kept spaced from the bottom face 272 by a very small gap. Accordingly, the same effects as the first embodiment can be achieved.

The above embodiments are only used to illustrate the present invention, not intended to limit the scope thereof. Many modifications of the above embodiments can be made without departing from the spirit of the present invention.

What is claimed is:

1. A pneumatic sander structure comprising a housing, a pneumatic driving mechanism and a grinding mechanism which are disposed in the housing, the housing having an air incoming way and a air outgoing way, the pneumatic driving mechanism having an annular wall in which a rotary body with vanes is placed, the annular wall being formed with inlets and outlets for rotating the rotary body, an upper and a lower ends of the annular wall being respectively connected with an upper and a lower bearing seats having bearings therein, a shaft being fitted into the rotary body and the two bearings, a bottom end of the shaft being an eccentric block of the grinding mechanism, a top end of the eccentric block being a middle section coaxial with the shaft, a hollow dustproof cover being disposed between the middle section and the lower bearing seat, said sander structure being characterized in that the dustproof cover is positioned between a top face of the middle section and the bearing in the lower bearing seat, the dustproof cover being fixedly clamped by the top face of the middle section and an inner ring of the bearing, the dustproof cover being formed with a recess corresponding to the outer ring for avoiding unnecessary abrasion, an outer edge of the dustproof cover upward extending to a lower bottom face of the lower bearing seat and being kept spaced therefrom by a very small gap.

2. A pneumatic sander structure as claimed in claim 1, wherein the dustproof cover is made of metal sheet by punching.

3. A pneumatic sander structure as claimed in claim 1, wherein a washer is disposed between the dustproof cover and the inner ring of the bearing, an outer diameter of the washer being smaller than an inner diameter of an outer ring of the bearing.

4. A pneumatic sander structure as claimed in claim 1, wherein the outer edge of the dustproof cover extends to a bottom face of the lower bearing seat.

5. A pneumatic sander structure as claimed in claim 1, wherein a bottom face of the lower bearing seat is formed with an annular groove, the outer edge of the dustproof cover extending into the annular groove and being kept spaced from the circumference of the annular groove by a very small gap.

* * * * *